US008136661B2

(12) United States Patent
Lutzig et al.

(10) Patent No.: US 8,136,661 B2
(45) **Date of Patent: *Mar. 20, 2012**

(54) WRAPPED BUNDLE OF SMOKING ARTICLES

(75) Inventors: Bodo-Werner Lutzig, Chavornay (CH); Eduardo Schmitt, Santa Cruz do Sul-RS (BR)

(73) Assignee: Philips Morris USA Inc., Richmond, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/213,357

(22) Filed: Jun. 18, 2008

(65) Prior Publication Data

US 2008/0308432 A1 Dec. 18, 2008

(30) Foreign Application Priority Data

Jun. 18, 2007 (EP) ..... 07110491

(51) Int. Cl.
*B65D 85/10* (2006.01)

(52) U.S. Cl. ..... 206/265; 206/245; 206/273; 229/87.13; 229/160.1

(58) Field of Classification Search ..... 206/245, 206/264–275; 229/87.13, 160.1, 87.01
See application file for complete search history.

(56) References Cited

U.S. PATENT DOCUMENTS 1,117,016 A * 11/1914 Falk ..... 229/87.13
2,204,850 A * 6/1940 Escobales ..... 229/87.13
3,171,583 A * 3/1965 Klein ..... 229/316
3,273,784 A * 9/1966 Porter ..... 229/69
3,275,469 A * 9/1966 Streit ..... 428/350
3,402,877 A 9/1968 Pinkham
4,771,882 A * 9/1988 Lowe et al. ..... 206/268
4,852,734 A 8/1989 Allen et al.
5,292,058 A * 3/1994 Zoss et al. ..... 206/268
5,333,729 A * 8/1994 Wolfe ..... 206/268
5,341,925 A 8/1994 Fleenor et al.
5,427,235 A * 6/1995 Powell et al. ..... 206/245
5,819,924 A 10/1998 Sigrist et al.
6,164,444 A * 12/2000 Bray et al. ..... 206/268
6,878,224 B1 4/2005 Focke et al.
7,344,024 B2 3/2008 Focke et al.
2010/0163563 A1 7/2010 Lutzig

FOREIGN PATENT DOCUMENTS

DE 102008033937 A1 1/2009

(Continued)

OTHER PUBLICATIONS

European Search Report mailed Nov. 30, 2007 for Appln. No. 07110491.3.

(Continued)

*Primary Examiner* — Bryon Gehman
(74) *Attorney, Agent, or Firm* — Buchanan Ingersoll & Rooney PC

(57) ABSTRACT

A wrapped bundle comprises an inner liner wrapped about a predetermined collation of smoking articles. The inner liner comprises an inner liner outer edge and at least two sections defining an opening in the wrapped bundle. At least one section of the at least two sections is provided with an adhesive for releasably attaching the at least two sections to reclose the opening. The at least one section comprises a part of the inner liner outer edge.

7 Claims, 2 Drawing Sheets

FOREIGN PATENT DOCUMENTS

| | | | |
|---|---|---|---|
| EP | 0944539 | B1 | 3/2003 |
| GB | 780881 | A | 8/1957 |
| WO | WO96/37418 | A | 11/1996 |
| WO | WO 98/22367 | | 5/1998 |
| WO | WO 99/28212 | | 6/1999 |
| WO | WO 2008/062159 | A1 | 5/2008 |

OTHER PUBLICATIONS

Search Report and Written Opinion dated Jun. 12, 2009 for European Application No. 08172706.7-2308.
Search Report and Written Opinion mailed Mar. 30, 2010 for International Application No. PCT/EP2009/067737.

* cited by examiner

WRAPPED BUNDLE OF SMOKING ARTICLES

CROSS-REFERENCE TO RELATED APPLICATION

This application claims priority under 35 U.S.C. §119 to European Application No. 07110491.3, filed Jun. 18, 2007, the entire content of which is hereby incorporated by reference.

FIELD OF THE INVENTION

The invention relates to a wrapped bundle of smoking articles such as cigarettes.

BACKGROUND

For the purpose of packaging, a predetermined collation of a plurality of smoking articles is wrapped tightly into an inner liner to form a wrapped bundle.

After the bundle of smoking articles is wrapped in the inner liner the wrapped bundle is closed by gluing the flaps of the inner liner along the length of the wrapped bundle as well as on the bottom and the top.

Typically an inner liner used to wrap a bundle of smoking articles is made either from a single packaging material, for example paper or aluminum foil, or from a combination of packaging materials, for example paper, aluminum foil and a plastic material.

Typically, the wrapped bundle is then inserted into an outer pack, for example a hinge lid pack or the hinge lid pack is assembled around the wrapped bundle.

For hinge lid packs typically the top section of the inner liner is removable to allow access to the smoking articles. To facilitate the removal of the top section of the inner liner, a perforation line is provided on the inner liner. Once the top section has been removed the inner liner cannot be closed anymore and the protective function of the inner liner is reduced.

Alternatively, the wrapped bundle is the final pack. In that case the inner liner is the outer wrapper of the bundle of smoking articles. An example for such a wrapped bundle is given in the EP 944 539. The wrapped bundle of the EP 944 539 comprises a collation of smoking articles which is sealed into an inner liner. The inner liner comprises an aperture in the top section. To add stability, the wrapped bundle further comprises an inner frame arranged partly around the smoking articles within the wrapped bundle. The aperture in the inner liner of the EP 944 539 requires a sophisticated inner liner blank.

There is a need for a wrapped bundle of smoking articles which provides improved protection from heat, loss of moisture and humidity after the wrapped bundle has been opened, which is simple in structure and cost effective in production.

SUMMARY

According to one embodiment, a wrapped bundle of smoking articles is provided, comprising an inner liner wrapped about a predetermined collation of smoking articles, the inner liner comprising an inner liner outer edge, the inner liner further comprising at least two sections defining a reclosable opening in the wrapped bundle. At least two sections of the inner liner are provided with means for releasably attaching the at least two sections to reclose the opening of the wrapped bundle, wherein at least one of the two sections comprises a part of the inner liner outer edge.

The possibility to reclose the wrapped bundle enhances the protection of the remaining smoking articles by the inner liner. At the same time, the layout of such an inner liner blank corresponds to the layout of a typical inner liner used in wrapping a bundle of smoking articles. In essence, besides the additional application of the means for releasably attaching the sections covering the opening of the wrapped bundle, a conventional inner liner for wrapping smoking articles may be used with existing standard machinery. This makes the wrapped bundle simple in structure and cost effective in production while at the same time improving the protection from heat, loss of moisture and humidity after the wrapped bundle has been opened.

Preferably, two of the at least two sections of the inner liner comprise a part of the inner liner outer edge. More preferably, all of the at least two sections of the inner liner comprise a part of the inner liner outer edge. The term "inner liner outer edge" is used throughout the specification to denote the edges of the inner liner that are the outer boundary of the sheet like material that is used to wrap the bundle of smoking articles.

Typically the wrapped bundle has a block shape, that is, the smoking articles are arranged in parallel to each other and the wrapped bundle has a rectangular cross section. Other cross sections like for example triangular, circular, trapezoid or hexagonal are also conceivable.

The term "long side" of the wrapped bundle is used throughout the specification to denote a side of the wrapped bundle that is parallel to the longitudinal axis of the smoking articles.

The term "short side" of the wrapped bundle is used throughout the specification to denote a side facing an end of the smoking articles. Depending on the arrangement of the wrapped bundle inside a pack for smoking articles, one of the short sides is referred to as the "top side" and the other side, opposite and parallel to the "top side" is referred to as "bottom side". Typically, the smoking articles are removable from the pack of smoking articles and the wrapped bundle through the "top side".

The term "inner surface" of the inner liner is used throughout the specification to denote the surface of the inner liner that faces the smoking articles in the wrapped bundle.

The term "outer surface" of the inner liner is used throughout the specification to denote the other surface of the inner liner, facing away from the smoking articles and facing the outer pack, if present.

Preferably, the number of sections of the inner liner that define the opening of the wrapped bundle is equal to the number of long sides of the wrapped bundle, for example six sections for a wrapped bundle with a hexagonal cross section. In embodiments with more than two sections, the number of sections that comprise connection means may be smaller than the number of sections that define the opening of the wrapped bundle. Preferably, the wrapped bundle has a rectangular cross section and the inner liner has four sections that define the opening in the wrapped bundle.

Preferably, the at least two sections defining the opening comprise overlappingly arranged flaps.

Preferably, the first section of the at least two sections of the inner wrapper is attached on the inner surface to the outer surface of a second section of the at least two sections of the inner wrapper. Preferably, the first section and the second section are part of the inner liner that covers the top side of the wrapped bundle. Alternatively, the first section of the inner liner is part of the inner liner that covers the top side of the wrapped bundle and the second section is part of the inner liner that covers at least partially at least one of the long sides of the wrapped bundle. In this embodiment, the first section extends over the top side of the wrapped bundle and is releasably attached to the long side of the wrapped bundle.

Preferably, the means for attaching the at least two sections comprise an adhesive, preferably a pressure sensitive adhesive. For example, the adhesive is applied to the inner side of the upper overlapping flap in order to reattach the overlapping flaps against one another. The application of an adhesive on the already existing flap of the inner liner is a cost-effective and simple realization of the reclosable opening of the inner liner. In particular, the functionality of a reclosable inner liner is achieved without additional reclosable labels or apertures in the inner liner.

Preferably, the adhesive is applied to at least one of the at least two sections in a dotted pattern. Alternatively or in combination with the dotted pattern, the adhesive may be applied to at least one of the at least two sections in a lines pattern, a grid pattern or in form of letter types or icons. Other suitable patterns are also conceivable. A suitable system for the application of the adhesive is a nozzle system, but any other suitable system may be used.

Preferred is an adhesive which substantially maintains its adhesive properties to make the inner liner sections reattach every time after a smoking article is taken out of the wrapped bundle, that is typically at least about 10 to about 30 times. A suitable adhesive is a low tack adhesive, for example a synthetic semi-pressure sensitive hotmelt adhesive such as PRIMAGRIP 38-638 or for example a water based polyethylene adhesive such as TOBACOLL ZD 4404-01, both available from HENKEL AG, or a removable acrylic based adhesive.

BRIEF DESCRIPTION OF THE DRAWINGS

Further aspects of the invention will become apparent from the following description of embodiments of the wrapped bundle with the aid of the drawings, in which.

DETAILED DESCRIPTION

Figure 1:
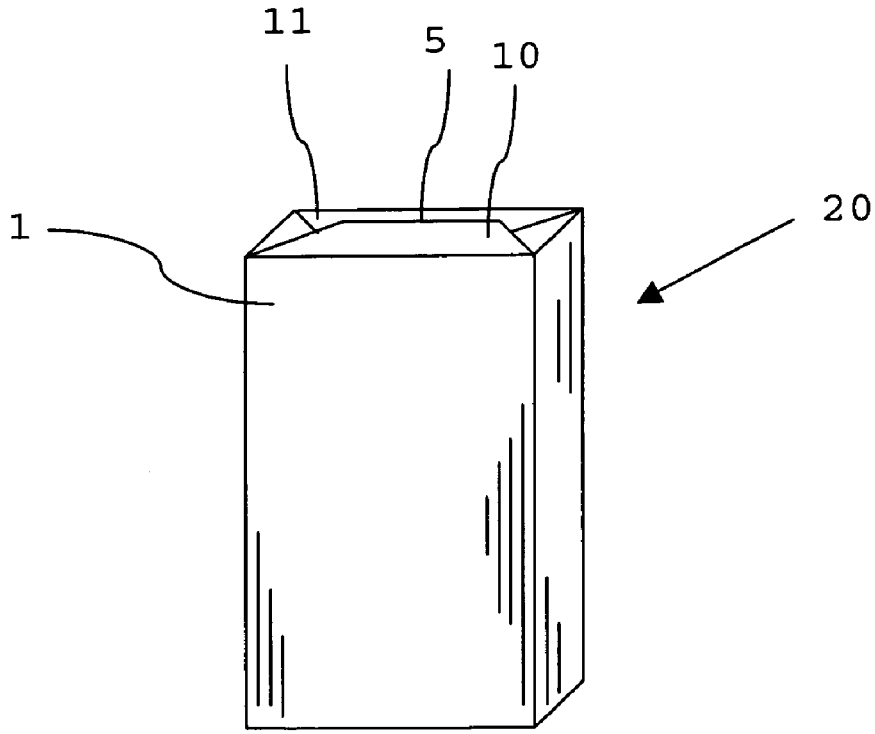
FIG. 1 shows a perspective view of a wrapped bundle of smoking articles, where the smoking articles are wrapped into the inner liner.
Figure 2:
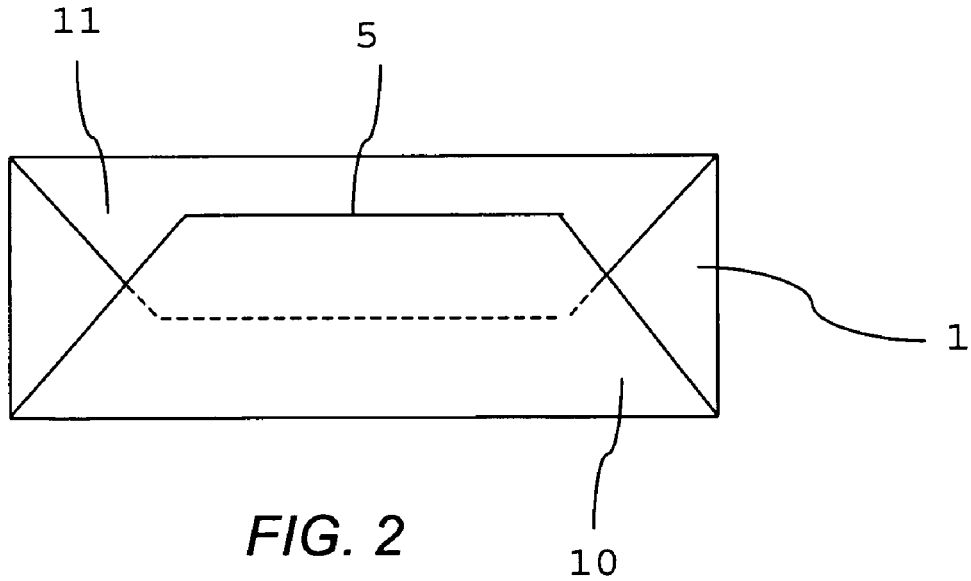
FIG. 2 shows a top view of the inner liner of FIG. 1, with overlappingly arranged flaps.

FIG. 1 and FIG. 2 show an inner liner 1 comprising overlappingly arranged flaps 10 and 11 at its top side in a closed state. The inner liner 1 is a rectangular sheet like material with an inner liner outer edge 5. In use the consumer creates an opening 3 (see FIG. 3 to 4) in the inner liner 1 of the wrapped bundle of smoking articles 2 by mechanically disconnecting overlappingly arranged flaps 10 and 11. After removing one or more of the smoking articles 2 from the bundle the consumer closes the opening 3 by attaching the overlapping flaps 10 and 11 to each other over the opening 3

Figure 3:
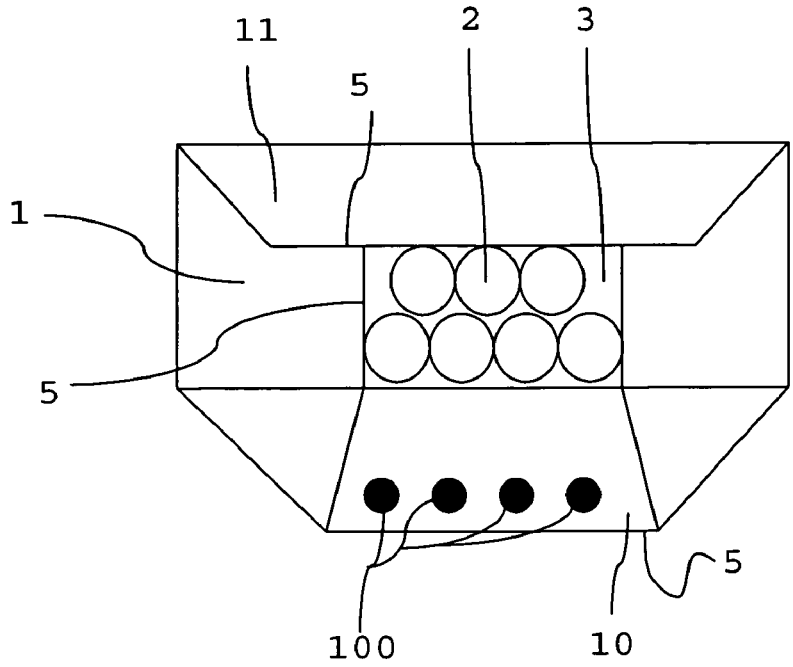
FIG. 3 shows a top view of the inner liner of FIG. 1, with its upper flap unfolded and adhesive dots applied on the inner surface of the upper flap.
Figure 4:
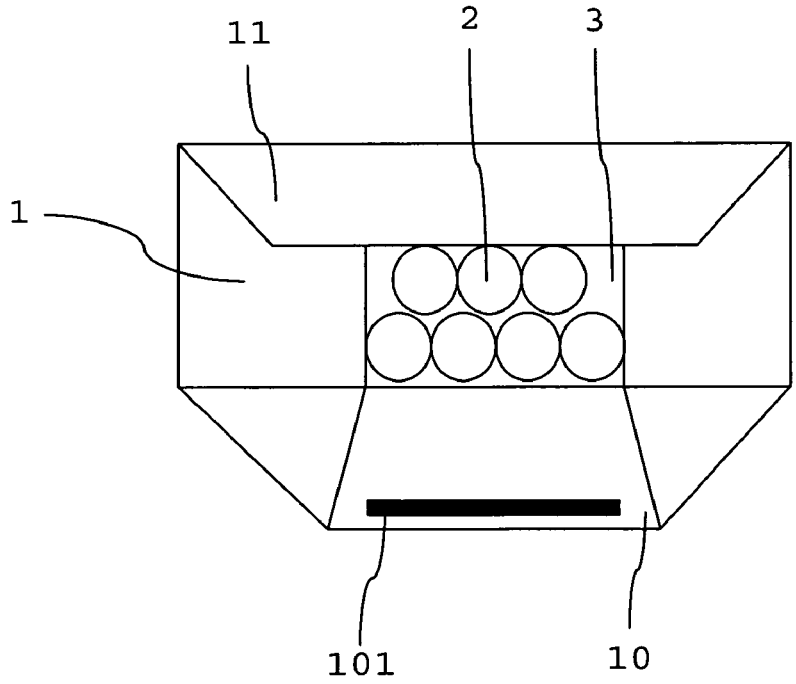
FIG. 4 shows a top view of the inner liner of FIG. 1, with its upper flap unfolded and an adhesive line applied on the inner surface of the upper flap.

In FIG. 3 an embodiment of the upper part of the inner liner 1 is shown with the upper flap 10 detached. As shown in FIGS. 2 to 4, the overlapping flaps 10, 11 comprise a part of the inner liner outer edge 5. Adhesive is applied in a dotted pattern 100 on the inner surface of the upper flap 10. By means of the adhesive 100, the opening 3 of the wrapped bundle may be reclosed by the consumer through folding of the upper flap 10 towards the lower flap 11 and by pressing the upper flap 10 against the lower flap 11.

FIG. 4 shows an embodiment of the inner liner of FIG. 1 except that the adhesive is applied in a lines pattern 101 onto the inner surface of the upper flap 10 rather than in a dots pattern 100 as shown in FIG. 3.

The adhesive is preferably applied by a nozzle system onto the two overlappingly arranged flaps 10 and 11 but any other application technique could also be used. Alternatively a double sided tacky tape may be applied to at least one of the upper flap 10 or the lower flap 11.

Alternative means other than adhesive for attaching the two overlappingly arranged flaps 10 and 11 may be used, for example a Velcro®-fastener.

It is also conceivable that the inner liner 1 is produced with a perforation line in order to allow opening of the inner liner 1 either by tearing off the upper part of the inner liner 1 or by opening and reclosing the overlappingly arranged flaps 10 and 11.

The invention claimed is:

1. A wrapped bundle of a hinged lid pack, said wrapped bundle comprising:

a resealable inner liner formed of a rectangular sheet of material wrapped about a predetermined collation of smoking articles, said predetermined collation of smoking articles defining a front and a back, said smoking articles having a longitudinal direction, the resealable inner liner including:

an inner liner outer edge;

a first section; and a second section, said first section and said second section defining an opening in the resealable inner liner, the first section being provided with an adhesive for resealably attaching the first section and the second section to reclose the opening, the first section being longer than the second section in a direction transverse to the longitudinal direction of the smoking articles and extending front-to-back of the predetermined collation of smoking articles, wherein the adhesive is disposed along said first section, wherein the first section and the second section include overlappingly arranged flaps, and wherein the first section and the second section each partially cover the predetermined collation of smoking articles.

2. The wrapped bundle of claim 1, wherein the adhesive is applied to the first section in a dotted pattern.

3. The wrapped bundle of claim 1, wherein the adhesive is applied to the first section in a line pattern.

4. The wrapped bundle of claim 1, wherein the adhesive is a pressure sensitive adhesive.

5. The wrapped bundle of claim 1, wherein the adhesive is a water based polyethylene adhesive.

6. The wrapped bundle of claim 1, wherein the adhesive is a removable acrylic based adhesive.

7. The wrapped bundle of claim 1, wherein the adhesive is on an inner side of the first section.

* * * * *